US010094078B2

(12) United States Patent
Husar

(10) Patent No.: US 10,094,078 B2
(45) Date of Patent: Oct. 9, 2018

(54) COLD PLANER REAR DOOR AND SLIDING PLATES SEALING DESIGN

(71) Applicant: Caterpillar Paving Products Inc., Brooklyn Park, MN (US)

(72) Inventor: Lucian Mihai Husar, Rogers, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 258 days.

(21) Appl. No.: 15/060,299

(22) Filed: Mar. 3, 2016

(65) Prior Publication Data

US 2017/0254032 A1 Sep. 7, 2017

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/09; E01C 23/12
USPC ..... 299/1.4, 1.5, 1.9, 36.1, 39.1, 39.2, 299/39.4–39.6; 404/75, 76, 90–94
See application file for complete search history.

(56) References Cited

U.S. PATENT DOCUMENTS 6,923,508 B2 8/2005 Holl et al.
7,370,916 B2 5/2008 Ley et al.
8,899,690 B2 12/2014 Kotting et al.
2013/0082508 A1* 4/2013 Orefice ..... E01C 23/088 299/10
2014/0035343 A1* 2/2014 Berning ..... E01C 23/088 299/1.5

FOREIGN PATENT DOCUMENTS

CN 104631294 A 5/2015
EP 2112275 A2 10/2009
EP 2374937 A2 * 10/2011

OTHER PUBLICATIONS

PM102 Cold Planner, CAT, Cat® C7 Engine with ACERT, 16 pages.
Leading through passion, Cold Milling Machines, W 100 CFi W 120 CFi W 130 CFi, 16pages.

* cited by examiner

*Primary Examiner* — Sunil Singh
(74) *Attorney, Agent, or Firm* — Miller, Matthias & Hull

(57) ABSTRACT

In a cold planer, a rotor housing partially enclosing a rotor may have a rotor housing side wall with retention plates defining a space in which a rotor housing side plate disposed so that the side plate can translate and rotate relative to the rotor housing. A pair of side plate lift cylinders may operate to vary a vertical position of the rotor housing side plate and a rotation of the rotor housing side plate about a horizontal axis relative to the rotor housing. The cold planer may use information from one or more distance sensors to identify contours in a work surface over which the cold planer is propelled, and actuate the lift cylinders to adjust the position and orientation of the rotor housing side plate to closely track the contour of the work surface and substantially prevent ground material from escaping from the rotor housing.

20 Claims, 7 Drawing Sheets

COLD PLANER REAR DOOR AND SLIDING PLATES SEALING DESIGN

TECHNICAL FIELD

The present disclosure relates generally to cold planers and, more particularly, to a rotor housing side plate for a cold planer having a pair of lift cylinders for controlling a vertical position and a rotational orientation of the rotor housing side plate relative to a rotor housing of the cold planer.

BACKGROUND

Many machines are mobile machines configured to perform one or more tasks while traveling over a work surface, such as a road surface. A cold planer is an example of such a mobile machine. The cold planer may include a grinding mechanism such as a rotor that grinds a top layer of the work surface as the cold planer moves in a machine travel direction. The cold planer may include a conveyor connected to a frame of the cold planer that receives the material that is ground from the road surface by the rotor. The conveyor may convey the material to another vehicle, such as a dump truck, traveling next to the cold planer.

The rotor may be surrounded by a rotor housing to contain ground material from the work surface so that the material may be removed by the conveyor. A portion of the rotor extends below the rotor housing so that it can dig into the work surface. The rotor housing may include side plates that extend below the rotor housing to further retain the material ground out of the work surface by the rotor. In known cold planers, the side plate may lie on the work surface under the force of gravity and be dragged by the cold planer in a floating condition. An example of an alternative side plate arrangement is provided in U.S. Patent Appl. Publ. No. 2013/0082508 published on Apr. 4, 2013 to Orefice. In the published application, a side plate arrangement for a milling device includes a milling roller box arranged on a frame of the milling device, a side plate whose height can be adjusted and a side plate support having a swivel bearing with a swivel axis around which the side plate can swivel against the frame in a swivel area. One element of the milling device is a guide curve running concentrically to the swivel axis, with the help of which the swivel movement of the side plate around the swivel axis is carried out. Height adjustment of the side plate occurs actively through a lifting device linked to the side plate, specifically through a one cylinder piston unit. After being positioned at the desired height, the side plate skids along a work surface and rotates about a swivel axis as the milling device passes over an uneven work surface.

SUMMARY OF THE DISCLOSURE

In one aspect of the present disclosure, a cold planer is disclosed. The cold planer may include a rotor, a rotor housing partially enclosing the rotor and having a rotor housing side wall, a first side plate retention plate mounted on the rotor housing side wall and defining a rotor housing side plate space there between, a rotor housing side plate disposed within the rotor housing side plate space so that the rotor housing side plate can move vertically relative to the rotor housing and rotate about a horizontal axis that is perpendicular to a machine travel direction, a first rotor housing side plate lift cylinder having a first cylinder first end fixed relative to one of the rotor housing and a frame of the cold planer and a first cylinder second end connected to the rotor housing side plate, and a second rotor housing side plate lift cylinder having a second cylinder first end fixed relative to the one of the rotor housing and the frame and a second cylinder second end connected to the rotor housing side plate. The first rotor housing side plate lift cylinder and the second rotor housing side plate lift cylinder may operate to vary a vertical position of the rotor housing side plate and a rotation of the rotor housing side plate about the horizontal axis relative to the rotor housing.

In another aspect of the present disclosure, a method for adjusting a position of a rotor housing side plate relative to a rotor housing partially enclosing a rotor of a cold planer that moves in a machine travel direction over a work surface as the rotor is engaged to grind material from the work surface is disclosed. The method for adjusting may include engaging a rotor drive mechanism to drive the rotor, setting a rotor height of the rotor to a grinding height where the rotor will grind material from the work surface, engaging a cold planer drive mechanism to propel the cold planer in the machine travel direction, and sensing a distance to an upstream portion of the work surface upstream of the rotor housing side plate in the machine travel direction. The method for adjusting may further include determining, based on the distance to the upstream portion, a vertical position of the rotor housing side plate relative to the rotor housing and a rotational orientation of the rotor housing side plate about a horizontal axis perpendicular to the machine travel direction relative to the rotor housing to dispose a bottom edge of the rotor housing side plate proximate the upstream portion of the work surface when the rotor housing passes over the upstream portion of the work surface, and actuating rotor housing side plate actuators to dispose the rotor housing side plate at the vertical position and the rotational orientation when the rotor housing passes over the upstream portion of the work surface.

In a further aspect of the present disclosure, a cold planer is disclosed. The cold planer may include a rotor that grinds material from a work surface as the cold planer moves in a machine travel direction over the work surface, a rotor housing partially enclosing the rotor housing and having a rotor housing side wall, a first side plate retention plate mounted on the rotor housing side wall and defining a rotor housing side plate space there between, and a rotor housing side plate disposed within the rotor housing side plate space so that the rotor housing side plate can move vertically relative to the rotor housing and rotate about a horizontal axis that is perpendicular to the machine travel direction. The cold planer may further include a first rotor housing side plate lift cylinder having a first rotor housing side plate lift cylinder actuator, a first cylinder first end fixed relative to one of the rotor housing and a frame of the cold planer and a first cylinder second end connected to the rotor housing side plate, a second rotor housing side plate lift cylinder having a second rotor housing side plate lift cylinder actuator, a second cylinder first end fixed relative to the one of the rotor housing and the frame and a second cylinder second end connected to the rotor housing side plate, a first distance sensor mounted on one of the rotor housing and the frame of the cold planer upstream of the rotor housing side plate, and a controller operatively connected to the first rotor housing side plate lift cylinder actuator, the second rotor housing side plate lift cylinder actuator and the first distance sensor. The controller may be configured to receive first distance sensor signals from the first distance sensor indicating a distance to an upstream portion of the work surface upstream of the rotor housing side plate in the machine travel direction as the cold planer moves in the machine travel direction over the work surface, to determine from the first distance sensor signals a vertical position of the rotor housing side plate relative to the rotor housing and a rotational orientation of the rotor housing side plate about the horizontal axis perpendicular to the machine travel direction relative to the rotor housing to dispose a bottom edge of the rotor housing side plate proximate the upstream portion of the work surface when the rotor housing passes over the upstream portion of the work surface, and to transmit lift cylinder actuator control signals to the first rotor housing side plate lift cylinder actuator and the second rotor housing side plate lift cylinder actuator to cause the first rotor housing side plate lift cylinder and the second rotor housing side plate lift cylinder to position the rotor housing side plate at the vertical position and the rotational orientation when the rotor housing passes over the upstream portion of the work surface.

Additional aspects are defined by the claims of this patent.

DETAILED DESCRIPTION

Figure 1:
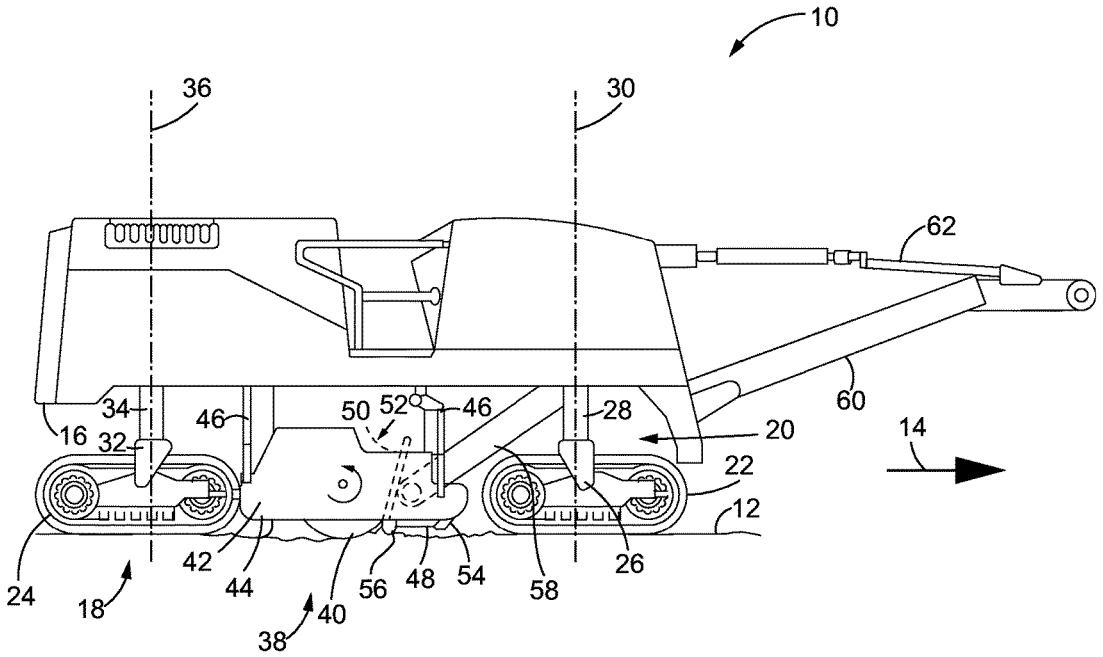
FIG. 1 is a side view of a cold planer on which a rotor housing side plate in accordance with the present disclosure may be implemented.

FIG. 1 illustrates an embodiment of a machine such as a cold planer 10 in accordance with the present disclosure. The cold planer 10 may be a mobile machine operable to move along a work surface 12 underneath the cold planer 10 in a machine travel direction 14. The work surface 12 may be a man-made surface, such as a road, parking lot, concrete cement, or other paved surface. The cold planer 10 may be configured to perform various functions when traveling over work surface 12. The cold planer 10 may be configured to cut or grind a top layer of concrete, asphalt, or similar material, to a desired depth below the work surface 12. Although the embodiments illustrated herein are directed to cold planers 10, those skilled in the art will understand that the structures and control strategies in accordance with the present disclosure may be implemented in other types of work machines configured to grind material from a work surface as the work machine travels across the work surface.

The cold planer 10 may include a frame 16. The frame 16 may serve to tie together and support other components and systems of the cold planer 10. Such systems may include a support system 18 to support the cold planer 10 from the work surface 12 and a steering system 20 to steer the cold planer 10 while moving along the work surface 12. The support system 18 may include one or more front ground engaging components 22 and one or more rear ground engaging components 24 configured to move along the work surface 12. FIG. 1 shows ground engaging components 22, 24 on the right side of the cold planer 10, and similar front and rear ground engaging components 22, 24 may be provided on a left side. Each ground engaging component 22, 24 may include any device or devices configured to move across the work surface 12, including but not limited to track units, wheels, and skids.

The front ground engaging component 22 may be connected to the frame 16 by an undercarriage bracket 26 connected to the ground engaging component 22, and a strut 28 connected to and extending up from the undercarriage bracket 26. The strut 28 may be engaged to the frame 16 directly or through one or more other components (not shown) in a manner allowing a front portion of the cold planer 10 to be supported by the strut 28. The engagement between the strut 28 and the frame 16 may be such that it allows rotation of the strut 28, the undercarriage bracket 26 and the ground engaging component 22 about a front vertical axis 30 relative to the frame 16 to facilitate steering of the ground engaging component 22 and, correspondingly, the cold planer 10. The steering system 20 may have one or more actuators (not shown) for controlling the rotation of the strut 28, the undercarriage bracket 26, and the ground engaging component 22 about the front vertical axis 30. Similarly, an undercarriage bracket 32 and a strut 34 may connect the rear ground engaging component 24 to the frame 16 so that actuators (not shown) of the steering system 20 may rotate the rear ground engaging component 24 about a rear vertical axis 36 to further contribute to the steering of the cold planer 10.

The frame 16 may also support a material removal mechanism 38 that is configured to cut or grind the top layer of the work surface 12. In the embodiment shown in FIG. 1, the material removal mechanism 38 may be a grinding mechanism that includes a rotor 40 with a plurality of teeth configured to grind the work surface 12. The material removal mechanism 38 may also include a rotor housing 42 defining a cutting chamber 44. A set of rotor positioning actuators 46 may be provided to raise and lower the rotor 40 and the rotor housing 42, typically in conjunction with adjustments to a cutting depth of the material removal mechanism 38 in a manner that will be familiar to those skilled in the art. The rotor 40 may rotate in a direction counter to the machine travel direction 14 of the cold planer 10 to grind material of the work surface 12 underlying the cold planer 10 as the cold planer 10 travels over the work surface 12. An anti-slabbing mechanism 48 may also be coupled to frame 16 and may include an upwardly oriented base plate 50 extending across a front side 52 of the rotor housing 42 and the cutting chamber 44, a forwardly projecting plow 54 for plowing loose material lying upon work surface 12, and a plurality of skids 56.

A lower conveyor 58 may be positioned forwardly of the base plate 50, and may be coupled to and supported upon the base plate 50, for feeding material ground from the work surface 12 by the rotor 40 to an upper conveyor 60 projecting forwardly from frame 16. A positioning mechanism 62 may be coupled with the upper conveyor 60 to enable left and right, and potentially up and down, position control of the upper conveyor 60 for conventional purposes. The upper conveyor 60 may further convey the ground material to a location off of the cold planer 10, such as to a receiving machine (e.g., another truck separate from the cold planer 10). For example, the receiving machine (not shown) may be a dump truck having a dumping bed that will receive the ground material from the upper conveyor 60. The dump truck may drive next to or in front of the cold planer 10 during grinding of the work surface 12 by the rotor 40, and travel at approximately the same speed as the cold planer 10. The positioning mechanism 62 may position an end of the upper conveyor 60 above the dumping bed so that the ground material conveyed by the upper conveyor 60 may be dropped into the dumping bed.

The cold planer 10 may also include one or more power sources (not shown) for powering the ground engaging components 22, 24, the material removal mechanism 38, the rotor positioning actuators 46, the conveyor 58, 60, and various other components and systems of the cold planer 10. For example, the cold planer 10 may include one or more internal combustion engines, batteries, fuel cells, or the like for providing power. The cold planer 10 may also include various provisions for transmitting power from such power sources to the material removal mechanism 38 and the various other components of the cold planer 10. Where the cold planer 10 includes an internal combustion engine as a power source, the cold planer 10 may include one or more mechanical or electrical power-transmission devices, such as, mechanical transmissions, hydraulic pumps and motors, electric generators and motors and other devices for transmitting power from the engine to the systems and mechanisms of the cold planer 10. For example, a propulsion system for driving the ground engaging components 22, 24 to propel the cold planer 10 may include a hydraulic pump (not shown) driven by a power source (not shown), one or more hydraulic motors (not shown) drivingly connected to ground engaging components 22, 24 to propel the cold planer 10.

The cold planer 10 may further include an operator control station 64 for an operator to perform control and monitoring of the various functions and components of the cold planer 10. To receive operator inputs for engagement of drive mechanisms for the ground engaging components 22, 24, the rotor 40 or the conveyors 58, 60, for positioning the material removal mechanism 38 relative to the work surface 12, or for other functions, the operator control station 64 may have corresponding operator input devices disposed therein and accessible to an operator. For example, as FIG. 1 shows, the steering system 20 may include a steering input device 66, such as a steering wheel, joystick, or other appropriate input mechanism, that an operator may manipulate to signal desired steering changes. Other appropriate input devices for controlling the operation of the systems and components of the cold planer 10 will be apparent to those skilled in the art and are contemplated by the inventor.

When the rotor 40 is lowered to a cutting depth to grind material from the work surface 12, the rotor housing 42 partially encloses the rotor 40 from above and laterally to substantially capture the ground material and transfer the material to the lower conveyor 58. However, it is typically impractical to place the rotor housing 42 in too close proximity to the work surface 12 in a manner that will prevent material from escaping between a bottom edge of the rotor housing 42 and the work surface 12. The work surface 12 may be uneven and have obstacles that must be traversed such as manhole covers that will vary the distance between the bottom edge and the work surface 12 and may engage and damage the rotor housing 42 if it is positioned too low. This spacing between the bottom edge and the work surface 12 may allow ground material to escape laterally from the rotor housing 42, resulting in additional manpower requirements for clearing the escaped material from the work area.

Figure 2:
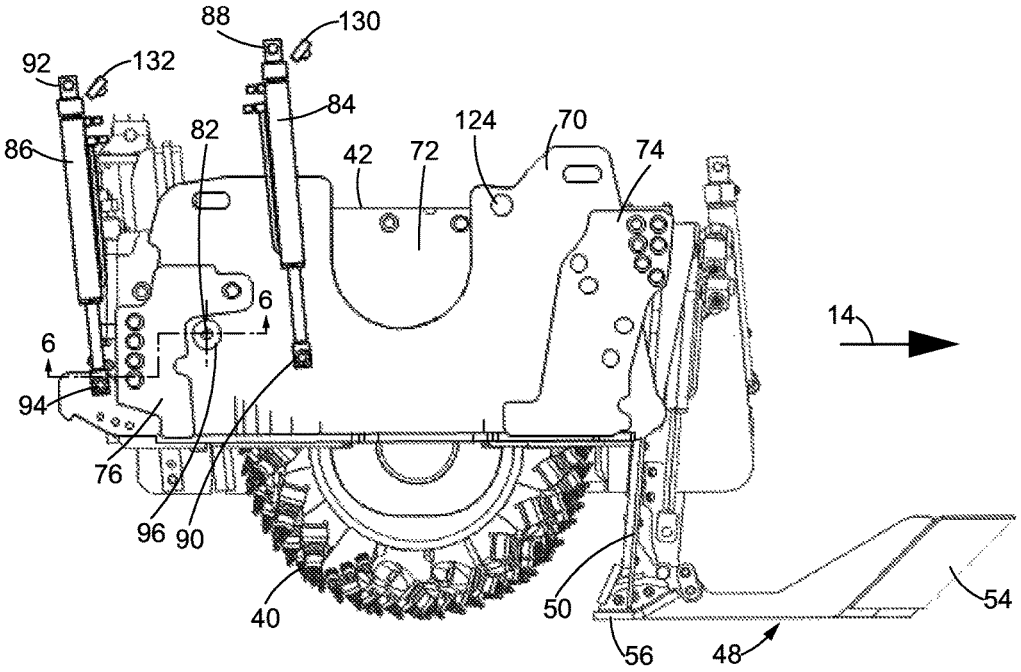
FIG. 2 is a side view of a rotor and rotor housing of the cold planer of FIG. 1 having a rotor housing side plate in accordance with the present disclosure with the rotor housing side plate in an elevated position.

The spaces at the lateral edges of the rotor housing 42 may be covered to further prevent loss of ground material by providing side plates that are capable of moving relative to the rotor housing 42 and being dispose more proximate to the work surface 12 as the rotor 40 operates to grind material from the work surface 12. FIG. 2 is a side view of the rotor 40 and the rotor housing 42 of the cold planer 10 having a rotor housing side plate 70 in accordance with the present disclosure. The rotor housing side plate 70 may be disposed adjacent a rotor housing side wall 72 of the rotor housing 42, and may be capable of movement relative to the rotor housing 42. A similar rotor housing side plate may be provided on the opposite side of the rotor housing 42 and may be similarly connected and manipulated as described herein for the rotor housing side plate 70.

The rotor housing 42 may further include a first side plate retention plate 74 mounted on the rotor housing side wall 72 proximate a front end of the rotor housing 42, and a second side plate retention plate 76 mounted on the rotor housing side wall 72 proximate a rear end of the rotor housing 42. As seen more clearly in FIGS. 3 and 4, the side plate retention plates 74, 76 may be mounted to the rotor housing side wall 72 with spacers 78, 80 there between so that the rotor housing side wall 72 and the side plate retention plates 74, 76 define a rotor housing side plate space within which the rotor housing side plate 70 is disposed. The rotor housing side plate space may provide sufficient room for the rotor housing side plate 70 to move vertically relative to the rotor housing 42 and to rotate about a horizontal axis that is perpendicular to the machine travel direction 14, such as the horizontal axis 82 identified in FIGS. 2-6.

It may be desirable to control the position of the rotor housing side plate 70 in accordance with the present disclosure within the rotor housing side plate space such that the rotor housing side plate 70 is maintained in close proximity to the work surface 12. Such control may require active movement of the rotor housing side plate 70 as the cold planer 10 travels over the work surface 12 and changes in the elevation of the work surface 12 are encountered. To effect control of the position of the rotor housing side plate 70, the cold planer 10 may include rotor housing side plate actuators such as a first rotor housing side plate lift cylinder 84 and a second rotor housing side plate lift cylinder 86. The first rotor housing side plate lift cylinder 84 may have a first cylinder first end 88 pivotally connected to one of the rotor housing 42 and the frame 16 of the cold planer 10, and a first cylinder second end 90 pivotally connected to the rotor housing side plate 70. Similarly, the second rotor housing side plate lift cylinder 86 may have a second cylinder first end 92 pivotally connected to the one of the rotor housing 42 and the frame 16, and a second cylinder second end 94 pivotally connected to the rotor housing side plate 70. As will be discussed more fully below, the side plate lift cylinders 84, 86 may be operated independently to extend and retract and thereby vary a vertical position of the rotor housing side plate 70 and a rotation of the rotor housing side plate 70 about the horizontal axis 82 relative to the rotor housing 42.

Figure 4:
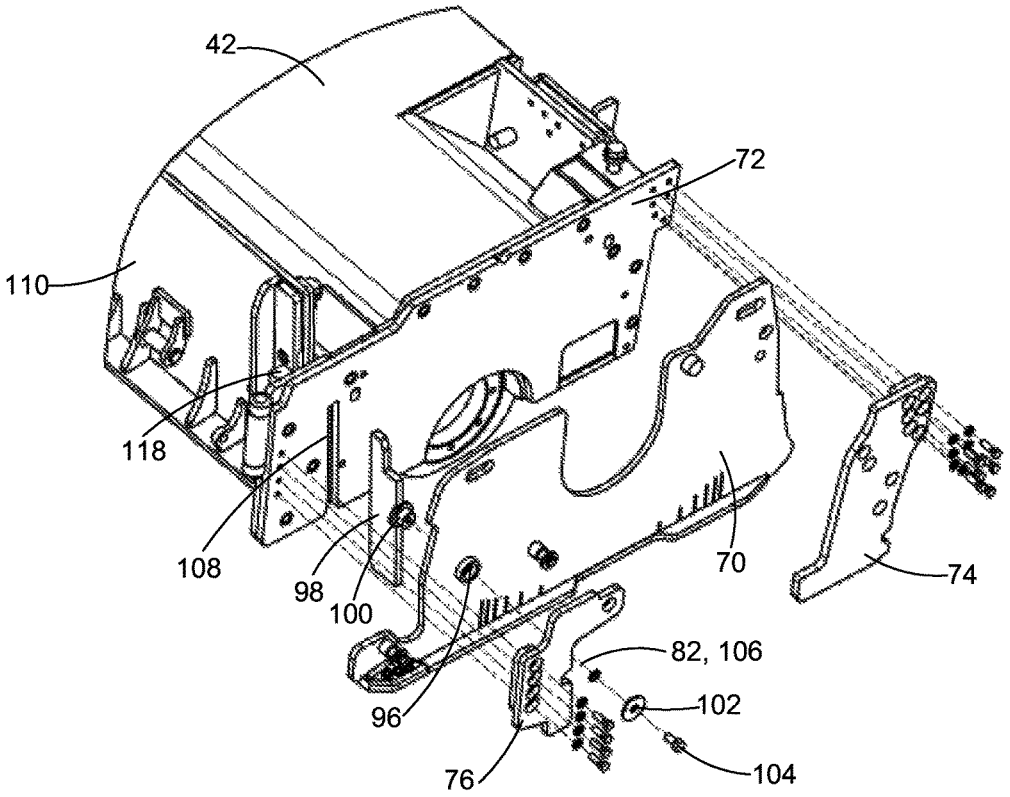
FIG. 4 is a partially exploded isometric view of the rotor housing and rotor housing side plate of FIG. 2.
Figure 5:
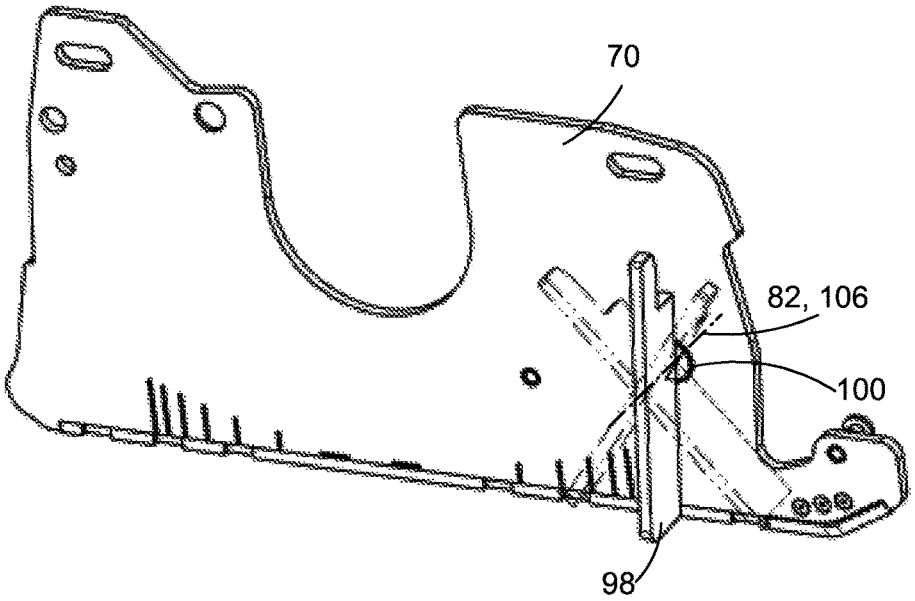
FIG. 5 is an isometric view of an inner surface of the rotor housing side plate of FIG. 2 and a rotating seal plate in accordance with the present disclosure.

The movement of the rotor housing side plate 70 may be further controlled by constraining the movement of the rotor housing side plate 70 relative to the rotor housing side wall 72. Referring to FIG. 4, a side plate swivel bearing 96 extending from an outer surface of the rotor housing side plate 70 may surround an opening through the rotor housing side plate 70. A rotating seal plate 98 may be pivotally connected to the rotor housing side plate 70 by inserting a seal plate swivel shaft 100 of the seal plate 98 into the opening at the side plate swivel bearing 96. The seal plate 98 may be secured to the rotor housing side plate 70 by seal plate mounting fasteners 102, 104. The seal plate swivel shaft 100 may allow the rotor housing side plate 70 and the seal plate 98 to pivot relative to each other about a seal plate rotational axis 106 of the seal plate swivel shaft 100 as shown in FIG. 4.

The movement of the rotor housing side plate 70 is constrained by a rotor housing side wall guide slot 108 defined in the rotor housing side wall 72. The rotor housing side wall guide slot 108 may be configured to receive the seal plate 98 therein. The seal plate 98 may be able to slide up and down within the rotor housing side wall guide slot 108 to restrict the side plate swivel bearing 96 and the rotor housing side plate 70 to translational motion along the side wall guide slot 108, and to substantially prevent the rotor housing side plate 70 from translating parallel to the machine travel direction 14.

Figure 3:
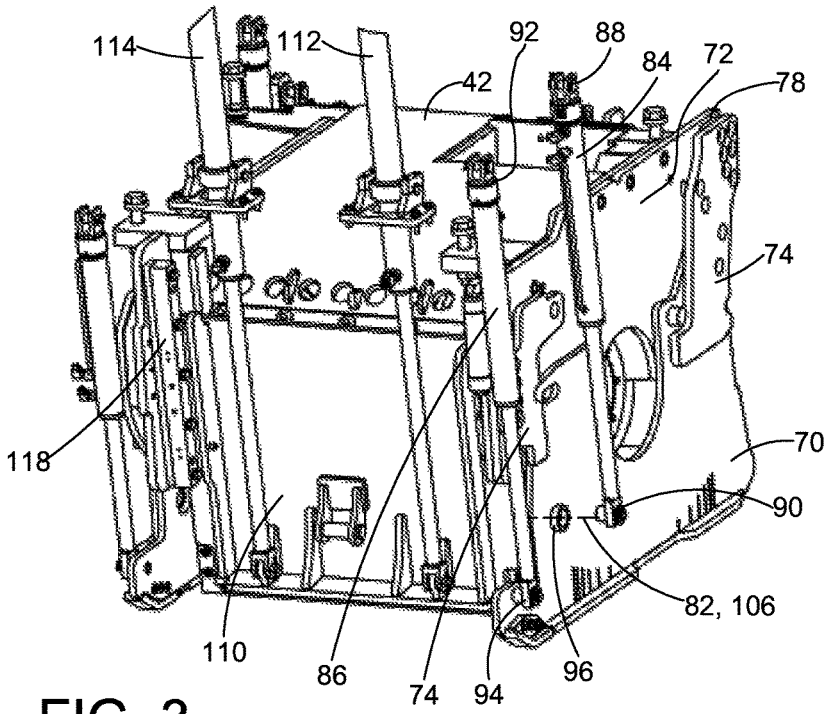
FIG. 3 is an isometric view of the rotor housing and the rotor housing side plate of FIG. 2.

In addition to constraining the movement of the rotor housing side plate 70, the seal plate 98 may also assist in retaining the ground material within the rotor housing 42 after the rotor 40 grinds the material out of the work surface 12. Referring to FIG. 3, the rotor housing 42 may further include a rotor housing rear door 110 that may provide access to the rotor 40 for inspection and maintenance. In the illustrated embodiment, the rotor housing rear door 110 may be constraint to slide up and down relative to the rotor housing 42. A first rotor housing rear door lift cylinder 112 and a second rotor housing rear door lift cylinder 114 may be connected between the rotor housing rear door 110 and either another portion of the rotor housing 42 or the frame 16 of the cold planer 10. When access to the rotor 40 is required, the rear door lift cylinders 112, 114 be retracted from an extended position as shown in FIG. 3 to a retracted position to raise the rotor housing rear door 110 and expose the cutting chamber 44.

Figure 6:
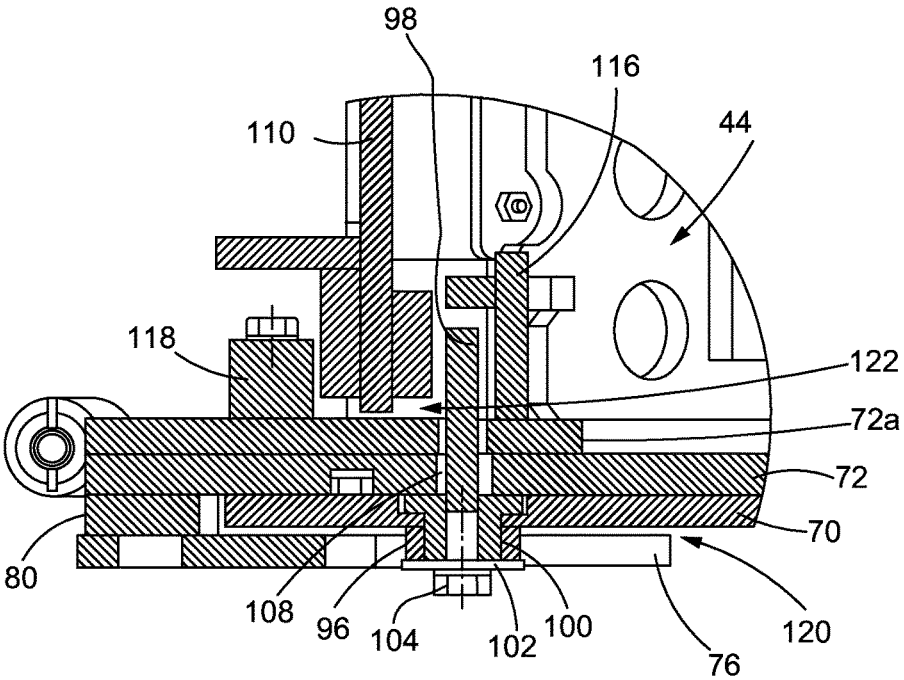
FIG. 6 is a cross-sectional view of the rotor housing and rotor housing side plate taken through line 6-6 of FIG. 2.

As shown in the cross-sectional view of FIG. 6, the rotor housing rear door 110 may be disposed between a rotor housing rear door inner retention plate 116 and a rotor housing rear door outer retention plate 118 to constrain the rotor housing rear door 110 to the up and down movement described above. FIG. 6 illustrates the right side of the rotor housing 42, and those skilled in the art will understand that a second set of retention plates 116, 118 will similarly constrain the rotor housing rear door 110 on the opposite side of the rotor housing 42. It should also be noted that FIG. 6 more clearly illustrates the rotor housing side plate space 120 defined between the rotor housing side wall 72 and the second side plate retention plate 76 within which the rotor housing side plate 70 is disposed and moves relative to the rotor housing side wall 72.

To facilitate free movement of the rotor housing rear door 110 relative to the other components of the rotor housing 42, the rotor housing rear door 110 may be spaced from an inner wall 72*a* of the rotor housing side wall 72, and thereby define a rotor housing gap 122 there between. In the area where the cross-section of FIG. 6 is taken within the area of the cutting chamber 44, the retention plates 116, 118 may extend across the rotor housing gap 122 to substantially prevent ground material from escaping through the rotor housing gap 122. However, during the grinding operation, the rotor 40, the rotor housing side plate 70 and the rotor housing rear door 110 extend lower than a bottom edge of the rotor housing side wall 72 and, correspondingly, bottom edges of the retention plates 116, 118. In that area, the rotor housing gap 122 widens to a distance between a lateral edge of the rotor housing rear door 110 and an inner surface of the rotor housing side plate 70. While portions of the rotor housing side plate 70 and the rotating seal plate 98 are below the rotor housing side wall 72, an upper portion of the seal plate 98 extends through the rotor housing side wall guide slot 108 to constrain the motion of the rotor housing side plate 70 as discussed above. In this position, the seal plate 98 traverses the portion of the rotor housing gap 122 between the rotor housing rear door 110 and the inner wall 72*a*, and traverses the portion of the rotor housing gap 122 between the rotor housing rear door 110 and the rotor housing side plate 70, to substantially prevent material within the interior of the rotor housing 42 from passing through the rotor housing gap 122 to the exterior of the rotor housing 42. Instead, the ground material is removed by the lower conveyor 58.

Returning to FIG. 2, additional structures may be provided to limit the translation motion of the rotor housing side plate 70. The side plate swivel bearing 96 may be positioned to engage the second side plate retention plate 76 to limit the upward vertical movement of the rotor housing side plate 70 when the side plate lift cylinders 84, 86 retract to raise the rotor housing side plate 70. Limiting the upward movement may prevent upper edges of the rotor housing side plate 70 from engaging other structures of the cold planer 10 such as the frame 16 that may cause damage to the engaging components. Additionally, a stop pin 124 may extend from an outer surface of the rotor housing side plate 70 and be positioned to engage the first side plate retention plate 74 to limit the downward vertical movement of the rotor housing side plate 70. Over extension of the rotor housing side plate 70 could place the side plate 70 below the side plate retention plates 74, 76 and outside the constraints of the rotor housing side plate space 120, resulting in instability of the side plate 70 and potential that the side plate 70 would not reenter the rotor housing side plate space 120 and be reengaged by the side plate retention plates 74, 76.

Utilization of two side plate lift cylinders 84, 86 may provide the opportunity for enhanced control of the position of the rotor housing side plate 70 relative to the work surface 12, and in particular for moving the rotor housing side plate 70 to account for unevenness in the work surface 12 and obstacles that must be traversed such as manhole covers as the cold planer 10 passes over the work surface 12. Actuation of the side plate lift cylinders 84, 86 can raise, lower and rotate the rotor housing side plate 70 to track the contour of the work surface 12 as it passes under the rotor housing 42. The contour of the work surface 12 upstream from the rotor housing side plate 70 may be determined as the material removal mechanism 38 moves in the machine travel direction 14. Knowing the approaching contour of the work surface 12, the position of the rotor housing side plate 70 may be adjusted by the side plate lift cylinders 84, 86 to minimize impacts with the work surface 12 while maintaining the rotor housing side plate 70 close to the work surface 12 so that minimal amounts of ground material escape from the cutting chamber 44.

To determine the contour of the approaching work surface 12, the cold planer 10 in the embodiment of FIG. 2 may include a first distance sensor 130 associated with the first rotor housing side plate lift cylinder 84, and a second distance sensor 132 associated with the second rotor housing side plate lift cylinder 86. The distance sensors 130, 132 may be mounted either on the frame 16 of the cold planer 10 or on the rotor housing 42 to maintain a relatively constant position with respect to the rotor housing 42 as the cold planer 10 traverses the work surface 12 and the rotor 40 grinds material from the work surface 12. The first distance sensor 130 may be oriented to sense a distance to a point on the work surface 12 that is upstream from the first rotor housing side plate lift cylinder 84 and the rotor housing side plate 70. The second distance sensor 132 may be oriented to sense a distance to a point on the work surface 12 that is upstream from the second rotor housing side plate lift cylinder 86. However, that point may or may not be upstream from the rotor housing side plate 70 depending on the particular implementation.

The distance sensors 130, 132 may be any appropriate type of distance sensor known in the art that transmits an electromagnetic field or beam and detects changes in the field or a return signal from which distance to a point on the work surface 12 may be determined. In response, the distance sensors 130, 132 may output distance sensor signals having values indicative of the sensed distance to the work surface 12. The sensed distances may then be used to determine a vertical position and rotational orientation of the rotor housing side plate 70 necessary for the rotor housing side plate 70 to remain above that portion of the work surface 12 when it passes under the rotor housing 42 and in close proximity for retention of the ground material. Processes for controlling the position of the rotor housing side plate 70 based on the information from the distance sensors 130, 132 are discussed in greater detail below.

Figure 7:
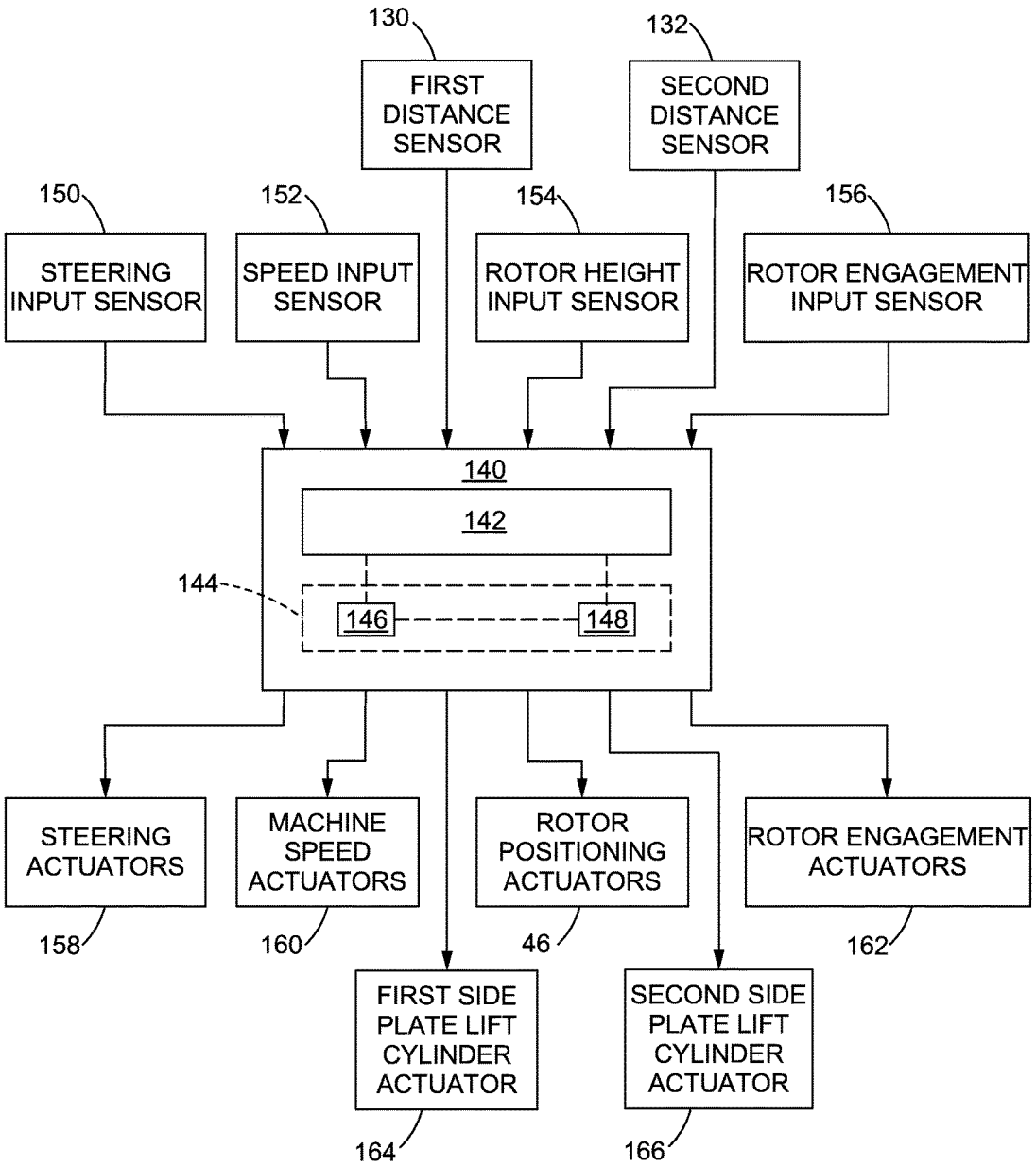
FIG. 7 is a schematic view of electrical components of the cold planer of FIG. 1.

Referring now to FIG. 7, the cold planer 10 may include various control components in addition to the distance sensors 130, 132 utilized in controlling the position of the rotor housing side plate 70. The cold planer 10 may include a controller 140 capable of receiving information in signals from control devices, sensors and other input devices, processing the received information using software stored therein, and outputting information to output devices such as actuators and displays that cause the cold planer 10 to operate and provide information to an operator of the cold planer 10. The controller 140 may include a microprocessor 142 for executing a specified program, which controls and monitors various functions associated with the cold planer 10. The microprocessor 142 includes a memory 144, such as read only memory (ROM) 146, for storing a program, and a random access memory (RAM) 148 which serves as a working memory area for use in executing the program stored in the memory 144. Although the microprocessor 142 is shown, it is also possible and contemplated to use other electronic components such as a microcontroller, an ASIC (application specific integrated circuit) chip, or any other integrated circuit device.

The controller 140 electrically connects to the control elements of the cold planer 10, as well as various input devices for commanding the operation of the cold planer 10 and monitoring the performance of the cold planer 10. As a result, the controller 140 may be electrically connected to input devices detecting operator input and providing control signals to the controller 140 that may include the steering input sensor 150, a speed input sensor 152, a rotor height input sensor 154, a rotor engagement input sensor 156, and the distance sensors 130, 132. The steering input sensor 150 may be operatively connected to the steering input device 66 (FIG. 1) within the operator control station 64 and may sense a displacement of the steering input device 66 indicative of an operator's intent to turn the ground engaging components 22, 24 and direct the cold planer 10 along a desired path. The steering input sensor 150 may respond by outputting a steering input sensor signal to the controller 140 that corresponds to the displacement of the steering input device 66. A value transmitted in the steering input sensor signal will correspond to the direction and magnitude of the displacement of the steering input device 66, and the controller 140 may be configured to interpret the steering input sensor signal.

The speed input sensor 152 may be operatively connected to a speed input device (not shown) in the operator control station 64, such as a gas pedal or accelerator, that is manipulated by the operator to regulate the speed of the cold planer 10 over the work surface 12. The speed input sensor 152 may sense a displacement of the speed input device indicative of a desired speed of the cold planer 10, and may respond by outputting a speed input sensor signal to the controller 140 that corresponds to the displacement of the speed input device. A value transmitted in the speed input sensor signal will correspond to the magnitude of the displacement of the speed input device, and the controller 140 may be configured to interpret the speed input sensor signal.

The rotor height input sensor 154 may be operatively connected to a rotor height input device (not shown) in the operator control station 64, such as a rotor height adjust lever, that is manipulated by the operator to position the rotor 40 relative to the work surface 12. The rotor height input sensor 154 may sense a displacement of the rotor height input device indicative of a desired height of the rotor 40 or movement of the rotor 40 toward or away from the work surface 12, and may respond by outputting a rotor height input sensor signal to the controller 140 that corresponds to the displacement of the rotor height input device. A value transmitted in the rotor height input sensor signal will correspond to the direction and the magnitude of the displacement of the rotor 40, and the controller 140 may be configured to interpret the rotor height input sensor signal.

The rotor engagement input sensor 156 may be operatively connected to a rotor engagement input device (not shown) in the operator control station 64, such as a switch or lever, that is manipulated by the operator to engage a rotor drive system of the cold planer 10 and cause rotation of the rotor 40. The rotor engagement input sensor 156 may sense a displacement of the rotor engagement input device indicative of a desire to engage or disengage the rotor drive system, and may respond by outputting a rotor engagement input sensor signal to the controller 140 that corresponds to the displacement of the rotor engagement input device. The controller 140 may be configured to interpret the rotor engagement input sensor signal, and to engage or disengage the rotor drive system based on the value of the rotor engagement input sensor signal.

In alternative implementations, some of the functions of the cold planer 10 may be automated and controlled by the controller 140 instead of being directly controlled by an operator. For example, the cold planer 10 may be provided with an input device having a graphical user interface at the operator control station 64, such as a touchpad, that may allow the operator to enter variables for grinding material from the work surface 12. Such variables may include a cutting depth for grinding material from the work surface 12, a speed of the cold planer 10 over the work surface 12 as the rotor 40 is grinding material, and the like. The programmed variables may be used by a control program stored in the memory 144 when the operator initiates execution of the control program to control functions of the cold planer 10 without relying on operator input. In such cases, control signals for factors such as the rotor height, rotor engagement and speed of the cold planer 10 may be generated at the controller 140 instead of at the corresponding sensors 152, 154, 156 as described above.

The controller 140 may also be electrically connected to output devices to which control signals are transmitted to execute the functions requested by the signals from the sensors 150, 152, 154, 156. Steering actuators 158 of the steering system 20 may be operatively coupled to the struts 28, 34 to cause rotation of the struts 28, 34 and correspondingly the ground engaging components 22, 24, respectively, in response to receiving steering control signals from the controller 140. Machine speed actuators 160 may receive machine speed control signals from the controller 140 and control propulsion system components such as an engine and transmission to propel the cold planer 10 over the work surface 12 at the commanded speed. The rotor positioning actuators 46 discussed above may receive rotor height control signals from the controller 140 and raise and lower the rotor 40 and rotor housing 42 in response. Rotor engagement actuators 162 may receive rotor engagement control signals from the controller 140 and respond by causing the rotor drive system to engage or disengage from the rotor 40, such as by manipulating transmissions or clutches of the rotor drive system.

A first side plate lift cylinder actuator 164 and a second side plate lift cylinder actuator 166 may be operatively connected to the side plate lift cylinders 84, 86, respectively, to control the extension and retraction of the side plate lift cylinders 84, 86 and, correspondingly, the position of the rotor housing side plate 70. The side plate lift cylinder actuators 164, 166 may be, for example, actuators of control valves (not shown) that control the flow of pressurized hydraulic fluid to the side plate lift cylinders 84, 86 to cause the side plate lift cylinders 84, 86 to extend or retract. The controller 140 may transmit lift cylinder actuator control signals to the side plate lift cylinder actuators 164, 166 to cause the side plate lift cylinders 84, 86 to move the rotor housing side plate 70 to a vertical position with a rotational orientation determined based on the contour of the work surface 12 indicated by the signals from the distance sensors 130, 132 while the rotor 40 is grinding material from the work surface 12 as discussed further below.

INDUSTRIAL APPLICABILITY

Figure 8:
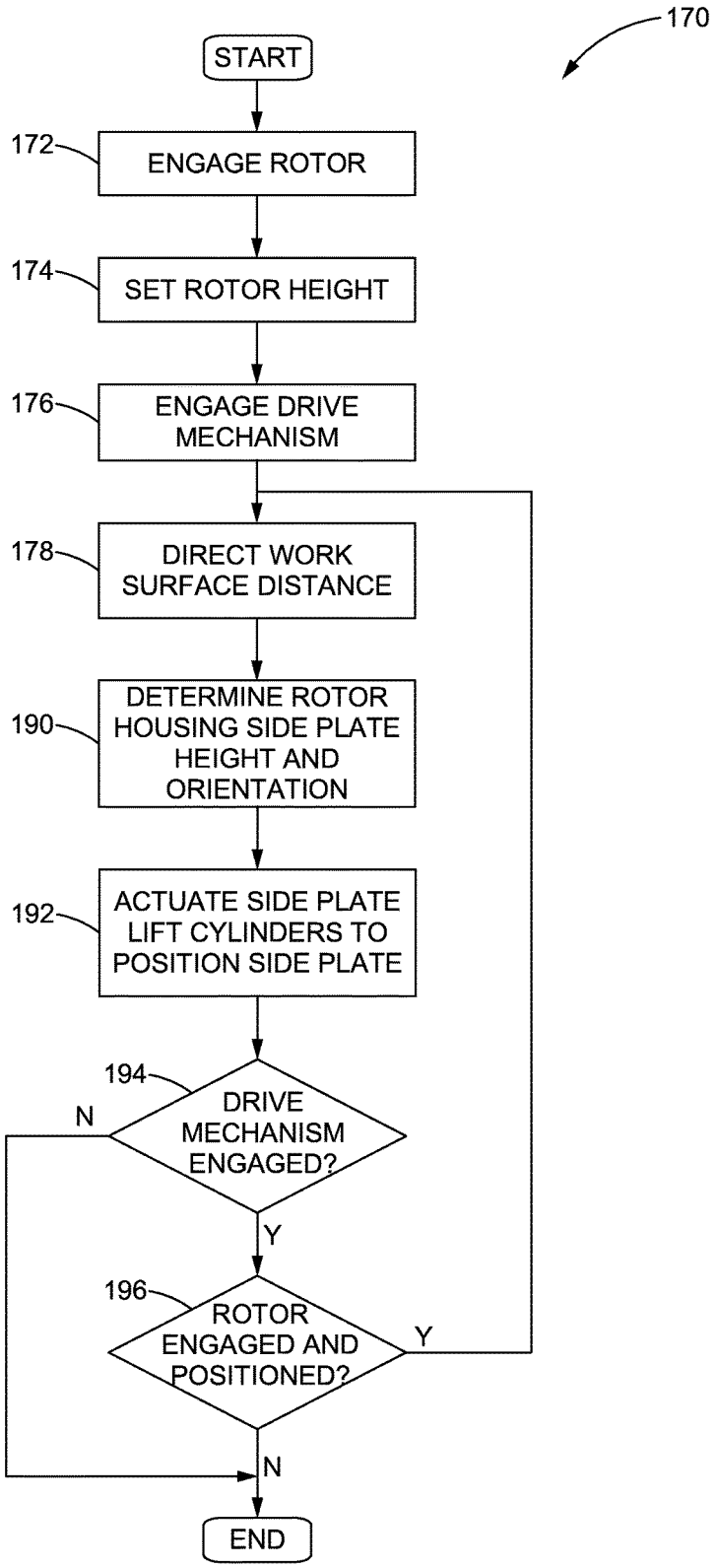
FIG. 8 is a block diagram of a rotor housing side plate positioning routine in accordance with the present disclosure that may be executed by the cold planer of FIG. 1.

FIG. 8 illustrates an exemplary rotor housing side plate position adjustment routine 170 that may be executed by the controller 140 when the cold planer 10 travels over the work surface 12 and the rotor 40 is positioned at a cutting depth and engaged to grind material from the work surface 12. The routine 170 may begin at a block 172 where the rotor 40 may be engaged by a rotor drive mechanism to rotate for grinding the material from the work surface 12. The rotor engagement input sensor 156 may sense actuation of the rotor engagement input device by an operator and respond by outputting the rotor engagement input sensor signals to the controller 140. The controller 140 may respond to the sensor signals by outputting rotor engagement control signals to the rotor engagement actuators 162 to cause the rotor drive system to engage the rotor 40 and cause rotation thereof.

Control may then pass to a block 174 where the height of the rotor 40 may be set to the cutting depth so that the rotor 40 will grind out a prescribed depth of material from the work surface 12. The rotor height input sensor 154 may sense displacement of the rotor height input device by the operator and respond by outputting the rotor height input sensor signals to the controller 140. The controller 140 may respond to the rotor height input signals by outputting rotor height control signals to the rotor positioning actuators 46 to lower the rotor 40 to the commanded cutting depth for removal of the material from the work surface 12.

With the rotor 40 engaged at the block 172 and lowered to specified cutting depth for grinding material at the block 174, control may pass to a block 176 where the cold planer drive mechanism for the cold planer 10 may be engaged to propel the cold planer 10 over the work surface 12 as the rotor 40 grinds material from the work surface 12. The operator in the operator control station 64 may actuate a clutch or other drive engagement input device to connect a power source of the cold planer 10 to the ground engaging components 22, 24 via a transmission or other power transfer device. The speed input sensor 152 may detect displacement of the speed input device by the operator and respond by outputting speed input sensor signals to the controller 140. The controller 140 may respond to the speed input signals by outputting speed control signals to the machine speed actuators 160 to begin propelling the cold planer 10 in the machine travel direction as the rotor 40 grinds material from the work surface 12.

Figure 9:
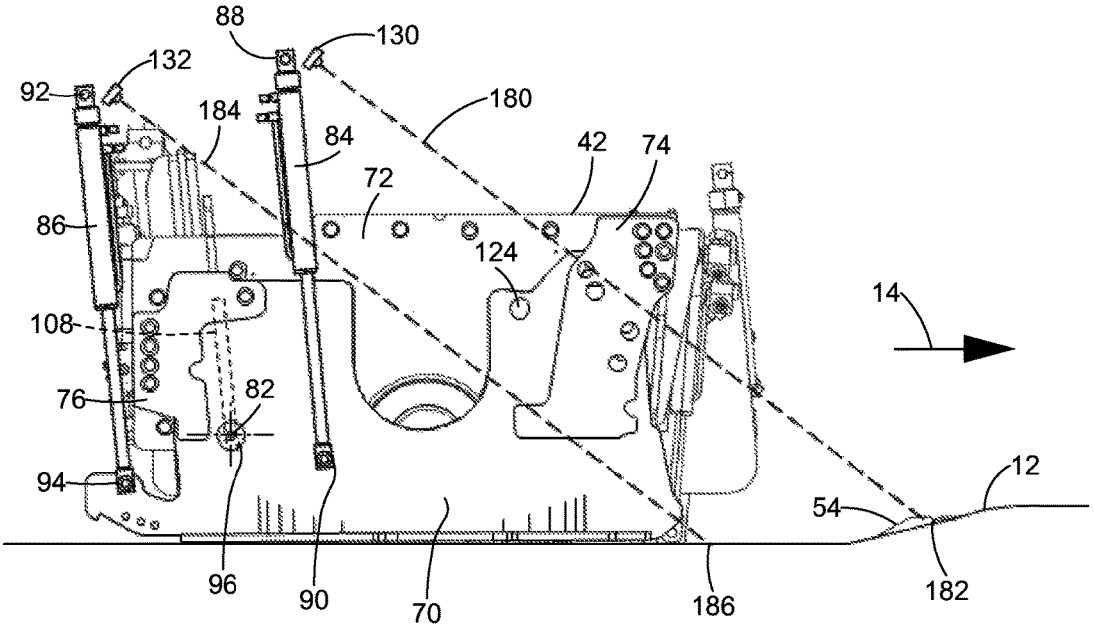
FIG. 9 is the side view of FIG. 2 with the rotor housing side plate in a lowered position.

As discussed above, the rotor housing 42 may not be lowered all the way to the work surface 12, and instead the rotor housing side plate 70 is lowered to a position where a bottom edge is disposed proximate the work surface 12 as shown in FIG. 9 to retain the ground material within the cutting chamber 44. Changes in the elevation of the work surface 12 may be apparent before the changes are encountered by the rotor housing side plate 70 so that the vertical position and the rotational orientation of the rotor housing side plate 70 can be adjusted. Referring back to the routine 170 of FIG. 8, control may pass to a block 178 wherein a distance to the work surface 12 is detected using the first distance sensor 130 and the second distance sensor 132.

As shown in FIG. 9, the first distance sensor 130 may project a first electromagnetic field or beam 180 at a first position 182 of the work surface 12 that is upstream from the rotor housing 42. The second distance sensor 132 may project a second electromagnetic field or beam 184 at a second position 186 of the work surface 12 that is upstream from the second rotor housing side plate lift cylinder 86 and may also be upstream from the rotor housing 42. The distance sensors 130, 132 may then detect reflections of the beams 180, 184 from the positions 182, 186 on the work surface 12 providing indications of a first distance and a second distance from the distance sensors 130, 132 to the positions 182, 186, respectively. In response, the distance sensors 130, 132 may transmit first distance sensor signals and second distance sensor signals, respectively, to the controller 140 having values indicative of the sensed distances from the distance sensors 130, 132 to the positions 182, 186 on the work surface 12.

As the controller 140 receives the distance sensor signals from the distance sensors 130, 132, control may pass to a block 190 of the routine 170 of FIG. 8 where the controller 140 may determine a height and orientation for the rotor housing side plate 70 to be disposed proximate the work surface 12 when the first position 182 and the second position 186 pass underneath the rotor housing side plate 70. Initially, the controller 140 may convert the distances from the distance sensor signals into heights of the positions 182, 186 relative to a reference such as a point on the frame 16 or the rotor housing 42. The calculated heights may establish lower limits on the downward position of the rotor housing side plate 70 when passing over the positions 182, 186. In the illustrated example, the upstream position 182 is higher than the downstream position 186. Consequently, the rotor housing side plate 70 should be oriented with a front portion elevated higher than a rear portion to maintain the bottom edge in as close proximity to the work surface 12 as practical. To achieve the orientation, the controller 140 may calculate a corresponding amount of rotation of the rotor housing side plate 70 about the horizontal axis 82. In the present example, the rotation may be counterclockwise as viewed in FIG. 9. Finally, with the height or elevation and the orientation of the rotor housing side plate 70 determined, the controller 140 may determine adjustments to the extension of the side plate lift cylinders 84, 86 required to transition the rotor housing side plate 70 from its current position to the position required when the positions 182, 186 pass under the rotor housing side plate 70. Those skilled in the art will understand that the logic set forth above for determining the height and orientation of the rotor housing side plate 70 based on the heights of the positions 182, 186 of the work surface 12 is exemplary. Alternative methods for converting the distance sensor signals into a height and orientation of the rotor housing side plate 70 and adjustments to the side plate lift cylinders 84, 86 will be apparent and are contemplated by the inventor as having use with cold planers 10 in accordance with the present disclosure.

With the height and orientation determined at the block 190, control may pass to a block 192 where the side plate lift cylinder actuators 164, 166 may be actuated to cause the side plate lift cylinders 84, 86 to position the rotor housing side plate 70 at the required height and orientation. In order to control the machine speed actuators 160 and the speed of the cold planer 10, the controller 140 may receive machine speed sensor signals from a machine speed sensor (not shown). The speed of the cold planer 10 in the machine travel direction may allow the controller 140 to calculate when the positions 182, 186 of the work surface 12 will pass under the rotor housing side plate 70, and correspondingly when the rotor housing side plate 70 should be at the height and orientation determined at the block 190. Using that information, the controller 140 may transmit lift cylinder actuator control signals to the lift cylinder actuators 164, 166 at the appropriate time.

Figure 10:
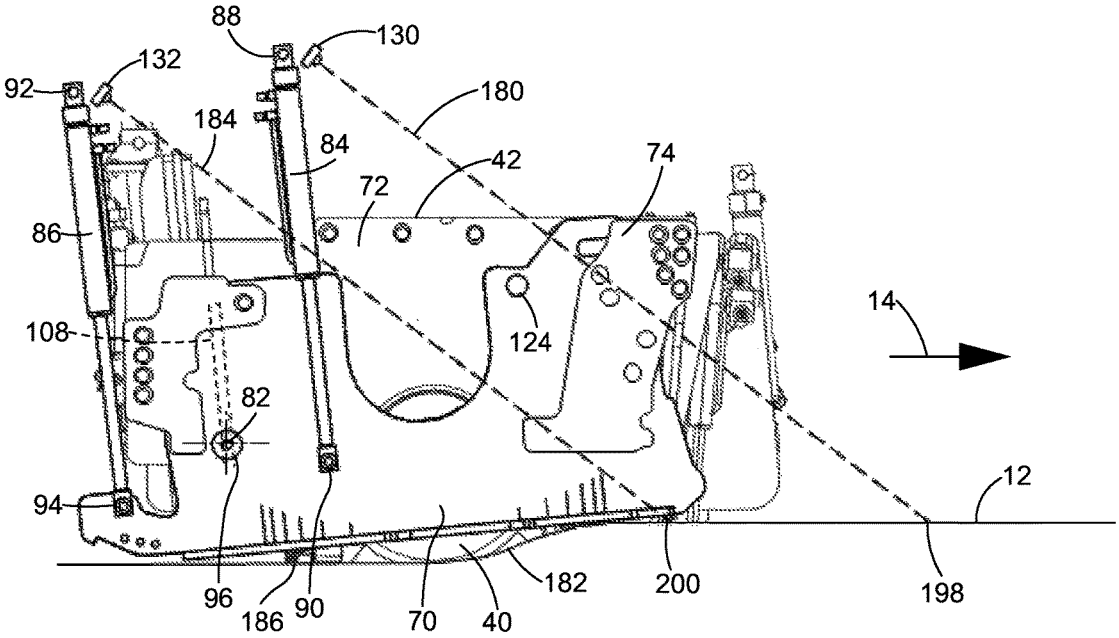
FIG. 10 is the side view of FIG. 2 with the rotor housing side plate in a partially elevated and rotated position.

When the control signals are transmitted, the side plate lift cylinder actuators 164, 166 may cause the side plate lift cylinders 84, 86, respectively, to move to the commanded positions. As shown in FIG. 10, the rotor housing side plate 70 is rotated to the position dictated by the positions 182, 186 of the work surface 12. To reach this position, the first rotor housing side plate lift cylinder 84 may be retracted to lift the front end of the rotor housing side plate 70. The retraction of the first rotor housing side plate lift cylinder 84 may cause the seal plate swivel shaft 100 to translate upward within the rotor housing side wall guide slot 108, and cause the rotor housing side plate 70 to rotate in the counterclockwise direction about the horizontal axis 82. In this position, the rotor housing side plate 70 may be disposed as close as practical to the work surface 12 to minimize the escape of ground material between the rotor housing side plate 70 and the work surface 12.

With the rotor housing side plate 70 positioned at the block 192, control may pass to a block 194 where the controller 140 may evaluate whether the cold planer drive mechanism is still engaged to propel the cold planer 10. If the drive mechanism is not engage, the cold planer 10 is no longer travelling over the work surface 12 and the height of the work surface 12 is not changing under the rotor housing side plate 70. In this condition, no further adjustment to the height and orientation of the rotor housing side plate 70 is necessary, and the routine 170 may end. If the drive mechanism is still engaged at the block 194, control may pass to a block 196 to determine whether the rotor 40 is still engaged and lowered to the cutting depth to grind material from the work surface 12. If the rotor 40 is disengaged and raised, the rotor housing side plate 70 is no longer proximate the work surface 12 and may not need to be adjusted. As with the disengagement of the drive mechanism, no further adjustment to the height and orientation or the rotor housing side plate 70 may be necessary, and the routine 170 may end.

Figure 11:
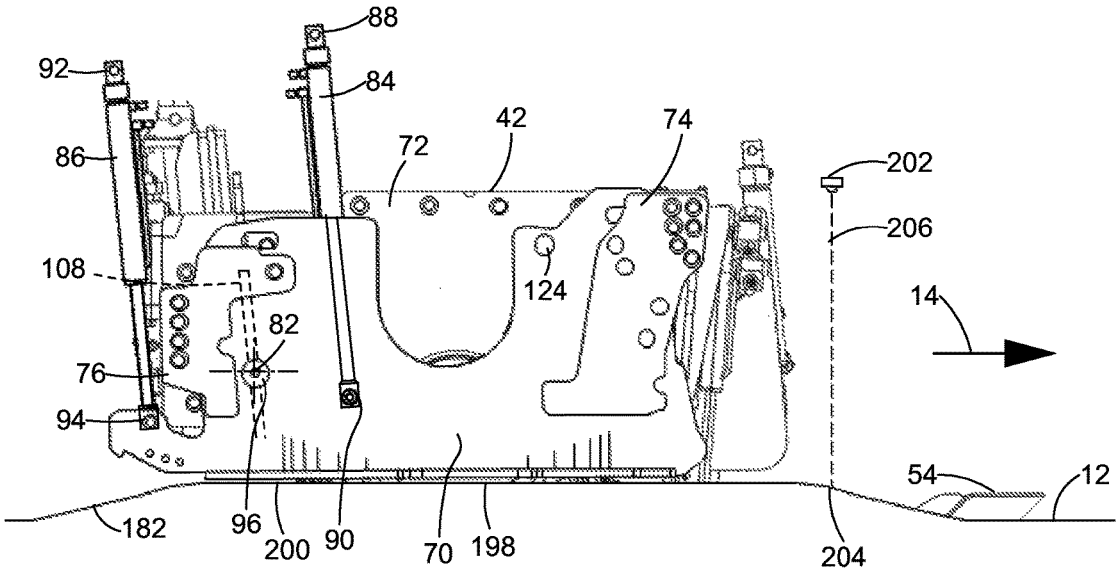
FIG. 11 is the side view of FIG. 2 with the rotor housing side plate in a raised position.

If the drive mechanism is engaged at the block 194 and the rotor 40 is still engaged and lowered into position at the block 196, control may pass back to the block 178 to continuously detect the work surface distance, determine the necessary height and orientation of the rotor housing side plate 70 to accommodate the contour or the work surface 12, and actuate the side plate lift cylinders 84, 86 to position the rotor housing side plate 70 accordingly. Consequently, as shown in FIG. 10, the distance sensors 130, 132 may detect the distances to subsequent positions 198, 200 on the work surface 12 as they approach the rotor housing 42 and the rotor housing side plate 70. As the subsequent positions 198, 200 pass under the rotor housing side plate 70, the side plate lift cylinders 84, 86 may be actuated to reposition the rotor housing side plate 70 as necessary as shown in FIG. 11. In moving the rotor housing side plate 70 from the position of FIG. 10 to the position of FIG. 11, the side plate lift cylinders 84, 86 may be actuated alone or in combination to cause the seal plate swivel shaft 100 to translate upward within the rotor housing side wall guide slot 108 and the rotor housing side plate 70 to rotate in the clockwise direction about the horizontal axis 82.

FIG. 11 also illustrates an alternative embodiment of the cold planer 10 wherein a single distance sensor 202 may be used to detect the height of the work surface 12 at a position 204 upstream from the rotor housing 42. The distance sensor 202 may be mounted on the frame 16 of the cold planer 10 upstream of the rotor housing 42 and project an electromagnetic field or beam 206 onto the position 204 on the work surface 12. The distance sensor 202 may continuously detect the distance to the position 204 as the cold planer 10 travels over the work surface 12, and the controller 140 may store the distance measurements from the distance sensor signals as a map of the contour of the work surface 12. Using the speed of the cold planer 10, the controller 140 may determine when various portions of the work surface 12 will pass under the rotor housing side plate 70 and continuously adjust the height and orientation of the rotor housing side plate 70 to match the contour of the work surface 12.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A cold planer comprising:

a rotor;

a rotor housing partially enclosing the rotor and having a rotor housing side wall;

a first side plate retention plate mounted on the rotor housing side wall and defining a rotor housing side plate space there between;

a rotor housing side plate disposed within the rotor housing side plate space so that the rotor housing side plate can move vertically relative to the rotor housing and rotate about a horizontal axis that is perpendicular to a machine travel direction;

a first rotor housing side plate lift cylinder having a first cylinder first end fixed relative to one of the rotor housing and a frame of the cold planer and a first cylinder second end connected to the rotor housing side plate; and a second rotor housing side plate lift cylinder having a second cylinder first end fixed relative to the one of the rotor housing and the frame and a second cylinder second end connected to the rotor housing side plate, wherein the first rotor housing side plate lift cylinder and the second rotor housing side plate lift cylinder are actuated to vary a vertical position of the rotor housing side plate and a rotation of the rotor housing side plate about the horizontal axis relative to the rotor housing.

2. The cold planer of claim 1, comprising a second side plate retention plate mounted on the rotor housing side wall and further defining the rotor housing side plate space there between.

3. The cold planer of claim 2, comprising a side plate swivel bearing mounted on the rotor housing side plate and positioned to engage the second side plate retention plate to limit an upward vertical movement of the rotor housing side plate.

4. The cold planer of claim 1, comprising a stop pin mounted on the rotor housing side plate and positioned to engage the first side plate retention plate to limit a downward vertical movement of the rotor housing side plate.

5. The cold planer of claim 1, wherein the rotor housing side wall has a rotor housing side wall guide slot defined therein and forcing a translational motion of the rotor housing side plate.

6. The cold planer of claim 5, comprising a rotating seal plate pivotally connected to the rotor housing side plate and disposed within the rotor housing side wall guide slot to force the translational motion of the rotor housing side plate.

7. The cold planer of claim 6, wherein the rotor housing side wall and a rotor housing rear door define a rotor housing gap there between, and wherein the rotating seal plate extends through the rotor housing side wall guide slot and traverses the rotor housing gap to substantially prevent material within an interior of the rotor housing from passing through the rotor housing gap to an exterior of the rotor housing.

8. A method for adjusting a position of a rotor housing side plate relative to a rotor housing partially enclosing a rotor of a cold planer that moves in a machine travel direction over a work surface as the rotor is engaged to grind material from the work surface, the method for adjusting comprising:

engaging a rotor drive mechanism to drive the rotor;

setting a rotor height of the rotor to a grinding height where the rotor will grind material from the work surface;

engaging a cold planer drive mechanism to propel the cold planer in the machine travel direction;

sensing a distance to an upstream portion of the work surface upstream of the rotor housing side plate in the machine travel direction;

determining, based on the distance to the upstream portion, a vertical position of the rotor housing side plate relative to the rotor housing and a rotational orientation of the rotor housing side plate about a horizontal axis perpendicular to the machine travel direction relative to the rotor housing to dispose a bottom edge of the rotor housing side plate proximate the upstream portion of the work surface when the rotor housing passes over the upstream portion of the work surface; and actuating rotor housing side plate actuators to dispose the rotor housing side plate at the vertical position and the rotational orientation when the rotor housing passes over the upstream portion of the work surface.

9. The method of claim 8, comprising continuously sensing the distance to the upstream portion of the work surface, determining the vertical position and the rotational orientation of the rotor housing side plate, and actuating the rotor housing side plate actuators as the cold planer continues to be propelled by the cold planer drive mechanism in the machine travel direction.

10. The method of claim 8, wherein sensing the distance to the upstream portion of the work surface comprises sensing the distance to the upstream portion of the work surface with a distance sensor mounted on one of the rotor housing and a frame of the cold planer upstream of the rotor housing side plate.

11. The method of claim 8, wherein the cold planer includes a first rotor housing side plate lift cylinder coupled between one of the rotor housing and a frame of the cold planer and a second rotor housing side plate lift cylinder coupled between the one of the rotor housing and the frame, wherein sensing the distance to the upstream portion of the work surface comprises sensing a first distance of the work surface upstream from the first rotor housing side plate lift cylinder with a first distance sensor and sensing a second distance of the work surface upstream from the second rotor housing side plate lift cylinder with a second distance sensor, and wherein determining the vertical position and the rotational orientation of the rotor housing side plate comprises determining the vertical position and the rotational orientation based on the first distance and the second distance sensed by the first distance sensor and the second distance sensor.

12. The method of claim 11, wherein the rotor housing side plate is positioned adjacent a rotor housing side wall of the rotor housing having a rotor housing side wall guide slot defined therein, and a rotating seal plate is pivotally connected to the rotor housing side plate and disposed within the rotor housing side wall guide slot to force a translational motion of the rotor housing side plate with the rotor housing side plate rotates relative to the rotating seal plate about a seal plate swivel shaft, wherein actuating the rotor housing side plate actuators comprises actuating a first rotor housing side plate actuator and a second rotor housing side plate actuator to slide the rotating seal plate within the rotor housing side wall guide slot and to pivot the rotor housing side plate about the seal plate swivel shaft to dispose the rotor housing side plate at the vertical position and the rotational orientation when the rotor housing passes over the upstream portion of the work surface.

13. The method of claim 8, comprising ceasing sensing the distance to the upstream portion of the work surface, determining the vertical position and the rotational orientation of the rotor housing side plate and actuating the rotor housing side plate actuators in response to determining that at least one of the cold planer drive mechanism is disengaged and the rotor height is not set to grind material from the work surface.

14. A cold planer comprising:

a rotor that grinds material from a work surface as the cold planer moves in a machine travel direction over the work surface;

a rotor housing partially enclosing the rotor housing and having a rotor housing side wall;

a first side plate retention plate mounted on the rotor housing side wall and defining a rotor housing side plate space there between;

a rotor housing side plate disposed within the rotor housing side plate space so that the rotor housing side plate can move vertically relative to the rotor housing and rotate about a horizontal axis that is perpendicular to the machine travel direction;

a first rotor housing side plate lift cylinder having a first rotor housing side plate lift cylinder actuator, a first cylinder first end fixed relative to one of the rotor housing and a frame of the cold planer and a first cylinder second end connected to the rotor housing side plate;

a second rotor housing side plate lift cylinder having a second rotor housing side plate lift cylinder actuator, a second cylinder first end fixed relative to the one of the rotor housing and the frame and a second cylinder second end connected to the rotor housing side plate;

a first distance sensor mounted on one of the rotor housing and the frame of the cold planer upstream of the rotor housing side plate; and a controller operatively connected to the first rotor housing side plate lift cylinder actuator, the second rotor housing side plate lift cylinder actuator and the first distance sensor, the controller being configured to:

receive first distance sensor signals from the first distance sensor indicating a distance to an upstream portion of the work surface upstream of the rotor housing side plate in the machine travel direction as the cold planer moves in the machine travel direction over the work surface, determine from the first distance sensor signals a vertical position of the rotor housing side plate relative to the rotor housing and a rotational orientation of the rotor housing side plate about the horizontal axis perpendicular to the machine travel direction relative to the rotor housing to dispose a bottom edge of the rotor housing side plate proximate the upstream portion of the work surface when the rotor housing passes over the upstream portion of the work surface, and transmit lift cylinder actuator control signals to the first rotor housing side plate lift cylinder actuator and the second rotor housing side plate lift cylinder actuator to cause the first rotor housing side plate lift cylinder and the second rotor housing side plate lift cylinder to position the rotor housing side plate at the vertical position and the rotational orientation when the rotor housing passes over the upstream portion of the work surface.

15. The cold planer of claim 14, wherein the first distance sensor is mounted on the one of the rotor housing and the frame of the cold planer upstream of the rotor housing side plate.

16. The cold planer of claim 14, comprising a second distance sensor operatively connected to the controller, wherein the first distance sensor senses the distance to the work surface upstream from the first rotor housing side plate lift cylinder and the second distance sensor senses the distance to the work surface upstream from the second rotor housing side plate lift cylinder, wherein the controller is configured to receive second distance sensor signals from the second distance sensor indicating the distance to the work surface upstream from the second rotor housing side plate lift cylinder, and the controller is configured to determine from the first distance sensor signals and the second distance sensor signals the vertical position and the rotational orientation of the rotor housing side plate to dispose the bottom edge of the rotor housing side plate proximate the upstream portion of the work surface when the rotor housing passes over the upstream portion of the work surface.

17. The cold planer of claim 14, comprising a second side plate retention plate mounted on the rotor housing side wall and further defining the rotor housing side plate space there between.

18. The cold planer of claim 14, wherein the rotor housing side wall has a rotor housing side wall guide slot defined therein and forcing a translational motion of the rotor housing side plate.

19. The cold planer of claim 18, comprising a rotating seal plate pivotally connected to the rotor housing side plate and disposed within the rotor housing side wall guide slot to force the translational motion of the rotor housing side plate.

20. The cold planer of claim 19, wherein the rotor housing side wall and a rotor housing rear door define a rotor housing gap there between, and wherein the rotating seal plate extends through the rotor housing side wall guide slot and traverses the rotor housing gap to substantially prevent material within an interior of the rotor housing from passing through the rotor housing gap to an exterior of the rotor housing.

* * * * *